US008450881B2

(12) United States Patent
Wortberg

(10) Patent No.: US 8,450,881 B2
(45) Date of Patent: May 28, 2013

(54) APPARATUS AND METHOD FOR PROTECTING AN ELECTRIC LINE

(75) Inventor: Michael Wortberg, Geisenhausen (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 229 days.

(21) Appl. No.: 12/640,551

(22) Filed: Dec. 17, 2009

(65) Prior Publication Data

US 2011/0096448 A1 Apr. 28, 2011

(30) Foreign Application Priority Data

Dec. 22, 2008 (DE) ..... 10 2008 064 393

(51) Int. Cl.
*H01H 83/00* (2006.01)
*H01H 79/00* (2006.01)

(52) U.S. Cl.
USPC ..... 307/131; 307/9.1; 307/10.1; 307/112; 307/116; 307/125; 307/139

(58) Field of Classification Search
USPC ..... 307/9.1, 10.1, 116, 125, 131, 139
See application file for complete search history.

(56) References Cited

U.S. PATENT DOCUMENTS 5,485,342 A * 1/1996 Sugino et al. ..... 361/104
5,666,254 A * 9/1997 Thomas et al. ..... 361/8
5,737,160 A * 4/1998 Duffy ..... 361/3
5,805,393 A * 9/1998 Thomas ..... 361/6
5,864,458 A * 1/1999 Duffy et al. ..... 361/93.9
6,492,747 B1 * 12/2002 Hoffmann ..... 307/131
6,556,403 B1 * 4/2003 Furuta et al. ..... 361/93.1
7,268,992 B2 * 9/2007 Hallak et al. ..... 361/93.7
7,453,680 B2 * 11/2008 Hallak et al. ..... 361/93.9
7,759,825 B2 * 7/2010 Heinrich ..... 307/139
7,875,997 B2 * 1/2011 George et al. ..... 307/117
7,986,024 B2 * 7/2011 Nirschl ..... 257/529
8,035,938 B2 * 10/2011 Divan ..... 361/58
2003/0080621 A1 * 5/2003 Kirk ..... 307/10.7
2005/0201032 A1 * 9/2005 Devine et al. ..... 361/93.1
2007/0258178 A1 * 11/2007 Hallak et al. ..... 361/93.7

(Continued)

FOREIGN PATENT DOCUMENTS

DE 195 04 561 A1 2/1995
DE 4445060 C1 1/1996

(Continued)

*Primary Examiner* — Adi Amrany
(74) *Attorney, Agent, or Firm* — Wolf, Greenfield & Sacks, P.C.

(57) ABSTRACT

The present invention relates to an apparatus and a method for protecting an electric line in a vehicle, it being possible to adapt the apparatus to the properties of the electric line to be protected. The apparatus for protecting an electric line comprises an electric fuse and a controllable switching element, the controllable switching element and the electric fuse being formed as a parallel circuit, and the parallel circuit being connectable in series to the electric line, the electric fuse being disposed in a first branch of the parallel circuit, which has a first resistance, and the controllable switching element being disposed in a second branch of the parallel circuit, and the controllable switching element being configured to accommodate at least two states, a first state with a second resistance higher than the first resistance, and a second state with a third resistance lower than the first resistance, and to switch into the second state when there is a pulse load condition.

10 Claims, 6 Drawing Sheets

U.S. PATENT DOCUMENTS

| | | | | |
|---|---|---|---|---|
| 2008/0130180 | A1* | 6/2008 | de Palma et al. | 361/56 |
| 2008/0137253 | A1* | 6/2008 | George et al. | 361/93.1 |
| 2009/0002119 | A1* | 1/2009 | Nirschl | 337/206 |
| 2009/0109590 | A1* | 4/2009 | Girot et al. | 361/93.8 |
| 2012/0134062 | A1* | 5/2012 | Wortberg | 361/87 |

FOREIGN PATENT DOCUMENTS

| | | | |
|---|---|---|---|
| DE | 19835781 | C2 | 2/2000 |
| EP | 1040495 | B1 | 10/2000 |
| FR | 2870996 | A1 * | 12/2005 |

* cited by examiner

APPARATUS AND METHOD FOR PROTECTING AN ELECTRIC LINE

FIELD OF THE INVENTION

The present invention relates to an apparatus and to a method for protecting an electric line in a vehicle, and in particular to an apparatus and to a method for protecting an electric fuse by means of a circuit element connected in parallel.

PRIOR ART

The protection of an electric line in a vehicle is generally implemented by means of a cut-out fuse which is typically designed for a uniformly distributed load of the electric line. However, temporary pulse loads, which are characterised by large current peaks, are particularly bad for the service life of a fuse since under certain circumstances the latter do not pose any problems for the electric line, but can however stress the fuse since the pulse loads come close to the actual triggering conditions, and so more frequently recurring pulse loads reduce the service life of the fuse. If, for example, fuses fuse in a range of 40-50 A, repeated current peaks in the range over 30 A lead to wear and deterioration of the fuse. Consequently, electric fuses are typically designed for larger currents, due to which the dimensions of the electric line are also adapted to this so that more materials and resources are consumed.

The characteristic curve for the characteristics of the pairing of the cut-out fuse and the line is shown in FIG. 6 in a double logarithmic current/time diagram. Here FIG. 6 shows an example of an electric line with a diameter of 1 $mm^2$ with a maximum temperature increase of 30° C. in comparison to electric fuses of alternatively 15 A, 20 A and 35 A. For example, a 1,000 sec long current pulse (almost direct current) with a current strength of 14 A can be carried. A current pulse which is only 1 sec long can, however, be carried up to a current strength of 100 A. This means that with the same current value the triggering time with a weaker fuse is shorter than with a stronger fuse, whereas with the same triggering time the weaker fuse can carry the smallest electric current.

The characteristic curve of the electric fuses in FIG. 6 differs from that of the electric line. For example, the 15 A cut-out fuse corresponds to the characteristics of the 1 $mm^2$ line in the range of the direct current load ($t>100$ secs). In the range of the pulse loads ($t<1$ sec), the 15 A cut-out fuse is already triggered with a substantially smaller load than could be carried by the line.

If the pulse load capacity of the electric line is stipulated by the connected load, a larger fuse would have to be used. In this example, a 35 A cut-out fuse would best correspond to the characteristics of the line. However, then the line is not sufficiently protected in the range $t>10$ secs (uniformly distributed load) and overload currents (sluggish short circuit, overload) can lead to the destruction of the electric line.

Since the characteristics of the cut-out fuse and the line are not adapted, the designing of line sets inherently involves oversizing of the cross-sections of the electric lines, and so inefficient utilisation of the resources, e.g. copper.

An example of this type of poor adaptation is the protection of an engine with a nominal output of 140 W/12 A. Since the engine draws a starting current which exceeds the nominal current six-fold, it cannot be protected with a 15 A fuse even though the electric line could carry this pulse load. Consequently, a larger fuse (30 A or 35 A) must be selected and so an electric line with a larger cross-section (4 $mm^2$).

In a conventional fuse for shortening the triggering time, a switch is provided parallel to a cut-out fuse, which can affect the current through the cut-out fuse. This fuse is designed such that during normal operation of the parallel circuit, during which the switch is closed, the main portion of the current through the parallel circuit is absorbed by the cut-out fuse, and the other part of the current flows through the path with the switch. If a temperature threshold or a current threshold is exceeded, the switch is opened so that the whole current is now absorbed by the cut-out fuse. In this way, during normal operation a smaller cut-out fuse can be selected so that the triggering time of the fuse is shortened when the switch is opened.

SUMMARY OF THE INVENTION

The object aims at providing an apparatus for protecting an electric line which can be adapted to the properties of the electric line to be protected.

According to one embodiment, the apparatus for protecting an electric line in a vehicle comprises an electric fuse and a controllable switching element, the controllable switching element and the electric fuse being formed as a parallel circuit, and the parallel circuit being connectable in series to the electric line. The electric fuse is disposed in a first branch of the parallel circuit, which has a first resistance, and the controllable switching element is disposed in a second branch of the parallel circuit. Furthermore, the controllable switching element is configured to accommodate at least two states—a first state with a second resistance higher than the first resistance, and a second state with a third resistance lower than the first resistance, and to switch into the second state when there is a pulse load condition.

The electric fuse is for example a cut-out fuse, and the controllable switching element is for example a power MOSFET.

This apparatus offers the advantage that due to the combination of the electric fuse and the controllable switching element, preferably a power semiconductor, the switching element can absorb the pulse load, and so the electric fuse can be protected when there are pulse loads. Therefore, pulse loads acceptable by the line can occur in the apparatus without the fuse being triggered.

According to one advantageous example, the pulse load condition constitutes an exceedance of a first threshold value of the current flowing through the parallel circuit. Therefore, the switching element can be controlled depending on a specific threshold value.

According to a further advantageous example, the controllable switching element is configured to switch from the second state into the first state if there is an overload condition. Therefore, a continuing overload condition can also trigger the electric fuse e.g. when a specific current level is exceeded for a specific time.

According to a further advantageous example, the controllable switching element is configured to switch from the second state into the first state if a second threshold value of the current flowing through the parallel circuit is fallen short of. Therefore, a normal state can be returned to, in which the current is largely or completely carried by the fuse.

According to a further advantageous example, the apparatus further comprises an ammeter which is connected in series to the electric fuse or the parallel circuit in order to measure a current through the cut-out fuse or the parallel circuit. Therefore, a switching condition can be determined.

According to a further advantageous example, the apparatus further comprises a voltmeter which is connected in parallel to the electric fuse or the parallel circuit in order to measure a voltage. Therefore, a current through the parallel circuit can also be deduced, i.e. a current through the electric line can be determined for a switching condition.

According to a further advantageous example, the apparatus further comprises a control unit for controlling the controllable switching element depending on the current flowing through the parallel circuit or depending on the current flowing through the parallel circuit and a duration of the current. Therefore, the controllable switching element can be controlled accordingly.

According to another embodiment, an onboard power supply system for supplying current to a vehicle, in particular an automobile, comprises the apparatus described above for protecting an electric line.

According to another embodiment, a method for protecting an electric line in a vehicle, to which a parallel circuit consisting of a controllable switching element and an electric fuse is connected in series, comprises the step: switching the controllable switching element from a first state with a second resistance higher than a first resistance of the electric fuse into a second state of the controllable switching element with a third resistance lower than the first resistance when there is a pulse load condition. Therefore, a current flowing through the parallel circuit can be conveyed through different branches depending on the height and the line to be protected.

According to one advantageous example, the method further comprises the step for determining whether the pulse load condition is given by measuring a current through the parallel circuit.

According to one advantageous example, the method further comprises the step for determining whether the overload condition is given by measuring a current through the parallel circuit and a duration of the current.

According to one advantageous example, the method further comprises the step for once again switching the controllable switching element, depending on the current flowing through the parallel circuit or depending on the current flowing through the parallel circuit and a duration of the current, from the second state into the first state.

Further advantageous features of the invention are disclosed in the detailed description of the embodiments and in the claims.

BRIEF DESCRIPTION OF THE DRAWINGS

In the following the invention is described in detail by means of the attached drawings.

DETAILED DESCRIPTION OF THE PREFERRED EMBODIMENTS

In the following preferred embodiments of the present invention are described in detail with reference to the accompanying drawings. Here the same or corresponding elements in the different drawings are respectively identified by the same or similar reference numbers.

The preferred embodiments of the invention, which are described in detail in the following, are described in detail with reference to an apparatus for protecting an electric line in a vehicle. It is noted, however, that the following description only includes examples, and should not be considered as restricting the invention.

Figure 1A:
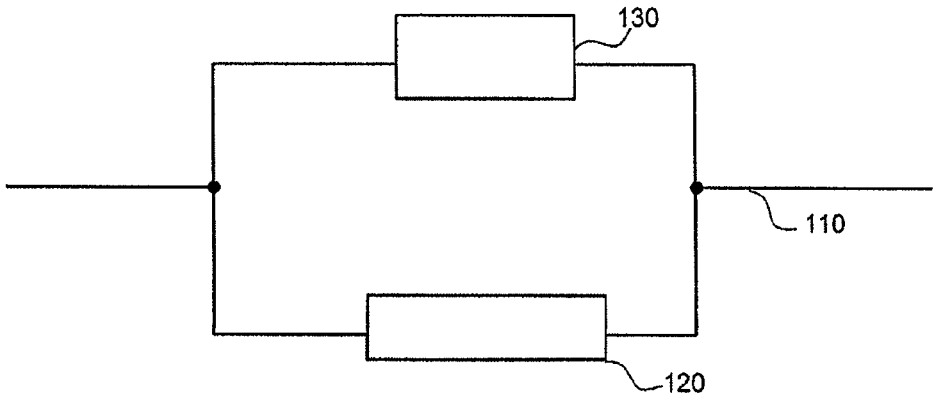
FIGS. 1A and 1B show diagrammatically apparatuses for protecting an electric line in a vehicle according to one embodiment.

FIG. 1A shows diagrammatically elements of an apparatus for protecting an electric line 110 in a vehicle. The apparatus comprises an electric fuse 120 and a controllable switching element 130 which are formed as a parallel circuit, and the parallel circuit being connected in series to the electric line 110. Moreover, the electric fuse 120, as shown in FIG. 1A, is disposed in a first branch of the parallel circuit, and the controllable switching element 130 is disposed in a second branch of the parallel circuit.

Figure 1B:
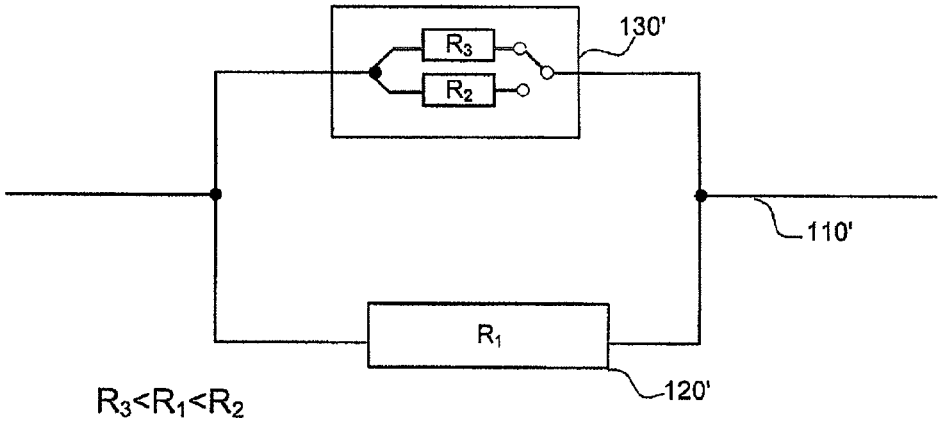

In FIG. 1B the elements of FIG. 1A are shown in greater detail, i.e. the electric line 110', the electric fuse 120' and the controllable switching element 130'.

In FIGS. 1A and 1B the electric fuse 120 is preferably formed by a cut-off fuse which has an electric resistance R1. As shown in FIG. 1B, the controllable switching element 130 can accommodate at least two states, namely a first state with a resistance R2, which is greater or higher than the resistance R1 of the electric fuse, and a second state with a resistance R3, which is lower than the resistance R1 of the electric fuse, and this can be demonstrated by the relationship R3<R1<R2 for the interpretation of the individual, preferably electric, resistances.

During normal operation of the fuse protection, the controllable switching element 130 is switched such that the controllable switching element accommodates the first resistance R2. For example, the switching element can be a switch, the resistance R2 corresponding to an open state, i.e. an unlimited resistance, and the resistance R3 corresponding to a closed state, i.e. to a very small resistance. Therefore, during normal operation the electric current flows through the electric line 110 via the electric fuse 120.

In particular, the controllable switching element 130 can be formed by a power MOSFET so that the first state of the controllable switching element 130 corresponds to an open power MOSFET so that the electric resistance R2 in this first state is of a size such that practically the whole current flows through the electric line 110 via the electric fuse 120.

As mentioned above, the controllable switching element 130 is configured to accommodate at least two states. In addition, the controllable switching element 130 is also configured to switch from the first state into the second state when there is a pulse load condition.

A pulse load condition is given, for example, if a current flowing through the parallel circuit exceeds a first threshold value, e.g. 30 A.

When a pulse load condition is given, the controllable switching element 130 can however switch into the second state for which the electric resistance R3 is smaller than the electric resistance R1 of the electric fuse R1. This is implemented for the use of a switch by closing the same. In this second state of the controllable switching element 130, due to R3<R1, the main part of the electric current flows through the electric line 110 via the controllable switching element 130, 130', and only a small part of the electric current via the electric fuse 120, 120', as a result of which the latter is unloaded if a pulse load condition is given. In other words, the controllable switching element 130, preferably a power MOSFET, can largely absorb this current load if there is a current pulse.

In the parallel circuit made up of the electric fuse 120 and the controllable switching element 130, due to R3<R1 a bypass current branch is produced by means of the electric fuse 120, and a main current branch by means of the controllable switching element 130, i.e. the main part of the electric current through the electric line 110 flows through the controllable switching element 130.

The apparatus can of course also return to normal operation. For example, the controllable switching element can be configured to switch from the second state into the first state if a second threshold value of the current flowing through the parallel circuit is fallen short of. This second threshold value is at least as high as, and preferably lower than the first threshold value due to possible hysteresis in the apparatus.

Furthermore, the controllable switching element can be configured to switch from the second state into the first state if there is an overload condition (which will be explained later), so that fusing or blowing of the electric fuse can be brought about.

Figure 2:
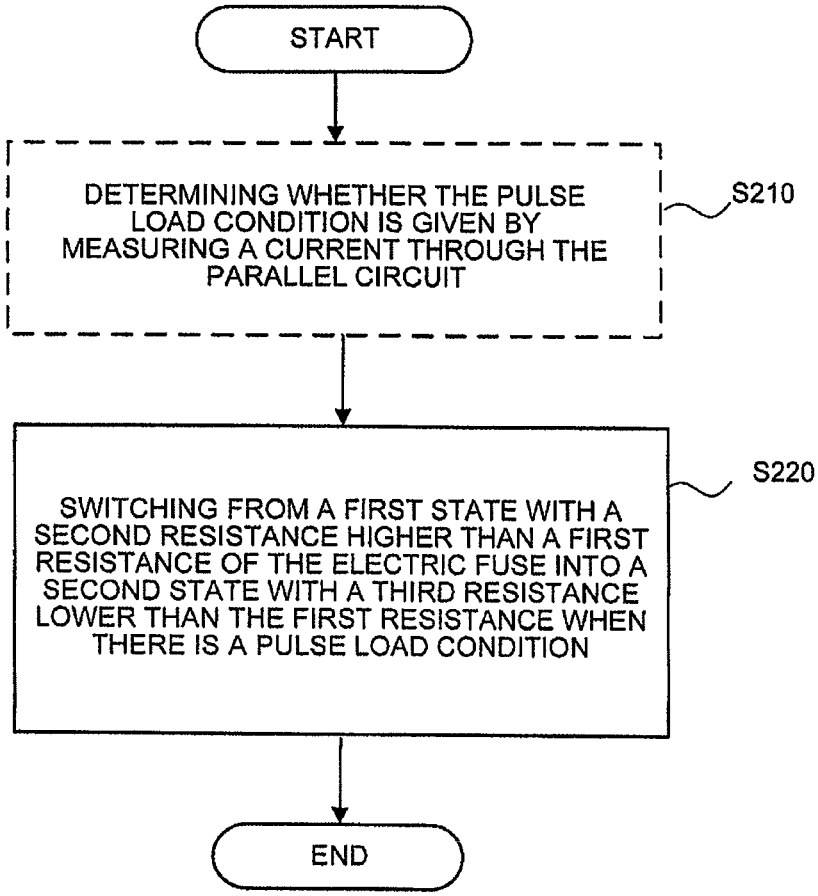
FIG. 2 shows a flow diagram which shows the steps of a method for protecting an electric line in a vehicle according to a further embodiment.

FIG. 2 shows a flow diagram with the steps of a method for protecting an electric line in a vehicle according to a further embodiment. Here it is determined in a first step S210 whether a pulse load condition is given. This determination can be implemented, for example, by determining a size of an electric current flowing through the parallel circuit, and this is why there are also other alternatives to step S210.

If a pulse load condition is given, in a second step S220 the controllable switching element 130 is switched from a first state with a second electric resistance R2 higher than a first electric resistance R1 of the electric fuse 120 into a second state of the controllable switching element 130 with a third electric resistance R3 lower than the first electric resistance R1. By means of this switching from the first state into the second state, as described above, the main part of the electric current flowing through the parallel circuit flows via the controllable switching element 130, by means of which the electric fuse 120 is unloaded if a pulse load condition is given, and so the latter does not immediately blow or fuse. Therefore, rapid deterioration of the fuse due to easy fusing etc. is also avoided.

Figure 3:
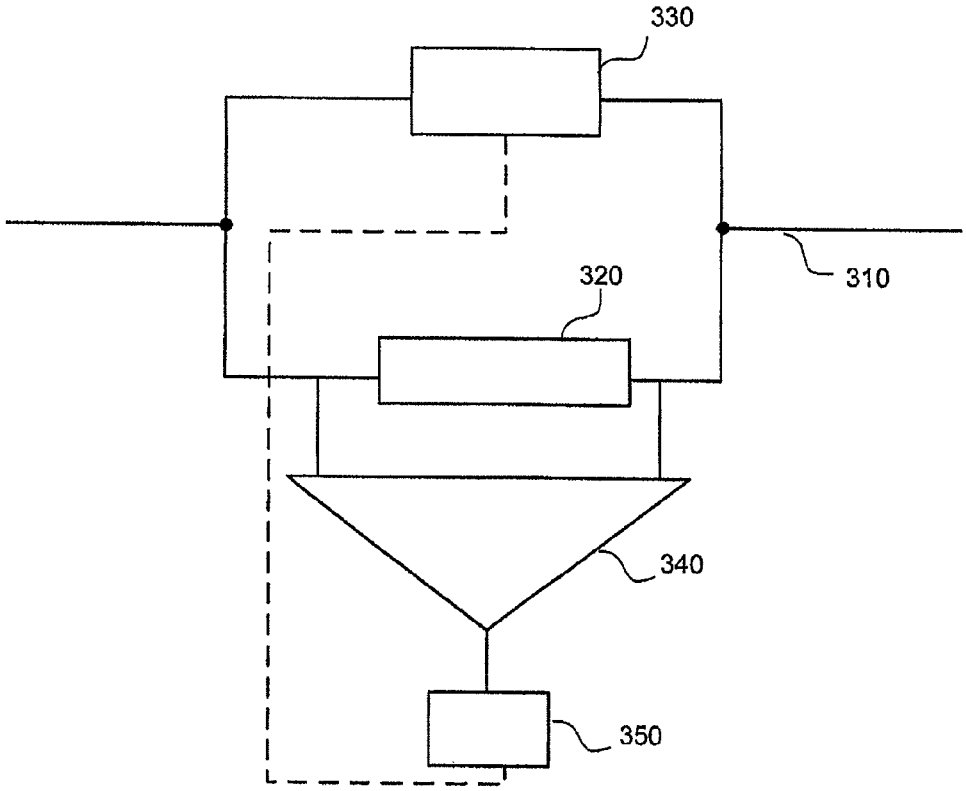
FIG. 3 shows diagrammatically an apparatus for protecting an electric line, in particular the control thereof, according to a further embodiment.

In the following an example of a control of the controllable switching element 330 is described with reference to FIG. 3. FIG. 3 diagrammatically shows an apparatus for protecting an electric line 310, and in particular the control thereof, according to a further embodiment.

The controllable switching element 330 in FIG. 3 corresponds basically to the controllable switching element 130 of FIG. 1, and can for example be formed as a power MOSFET. The electric fuse 320 corresponds to the electric fuse 120 in FIG. 1, and can be in the form, for example, of a cut-out fuse.

Furthermore, the apparatus for protecting comprises a comparator 340 and a control unit. The comparator 340 detects the drop in voltage via the electric fuse 320, by means of which the electric current can be calculated by the electric fuse 320. In this example, the control unit 350, preferably a microcomputer, is designed such that the controllable switching element 330 can be switched upon the basis of the current flowing through the electric fuse 320 or upon the basis of the current flowing through the electric fuse 320 and the duration thereof.

It should be mentioned in connection with FIG. 3 that the current measurement, and so the control of the controllable switching element 330, can be implemented not only by means of the electric fuse 320, but also by means of the whole parallel circuit or by means of the controllable switching element 330 itself.

According to the apparatus in FIG. 3, the controllable switching element 330 is switched such that if a pulse load condition is given, i.e. if it is determined by means of a comparator 340 that the current flowing through the electric fuse 320 exceeds a first current threshold value, e.g. 30 A, the controllable switching element 330 adopts the second state with an electric resistance R3 so that the main part of the electric current through the parallel circuit flows through the controllable switching element 330.

Moreover, the controllable switching element 330 in FIG. 3 can once again be switched from the second state into the first state depending on the current flowing through the parallel circuit. For example, if a second current threshold value, determined by means of a comparator 340, is fallen short of, a switch is once again made from the second state of the controllable switching element 330 with an electric resistance R3 into the first state with an electric resistance R1 so that the main part of the electric current through the parallel circuit flows through the electric fuse 330.

By means of this control of the controllable switching element 330 in FIG. 3 temporary pulse loading of the electric fuse 320 can be avoided. In particular, after setting a pulse load condition by exceeding the first current threshold value, the controllable switching element 330 is switched such that the main part of the electric current does not flow through the electric fuse 320, and if after a particular pulse loading time the second current threshold value, e.g. 25 A, is fallen short of again, the controllable switching element 330 is switched again such that the main part of the electric current flows through the electric fuse 320.

The second current threshold value preferably comes below the first current threshold value here in order to compensate hysteresis effects of the apparatus in FIG. 3.

By means of this advantageous control of the switching element 330 and the support of the electric fuse 320 in case of pulse loads, the latter can be given smaller dimensions, and the electric line 310 no longer needs to be adapted to the electric fuse 320, and this leads to less consumption of materials and energy. Consequently, the above apparatus can lead to a reduction in the cross-section of the electric line 310 by one order of magnitude.

It is noted that current flowing through the apparatus can either be measured indirectly by a voltmeter, or directly by an ammeter which is connected in series to the electric fuse or the parallel circuit in order to measure a current through the cut-out fuse or parallel circuit.

Figure 4:
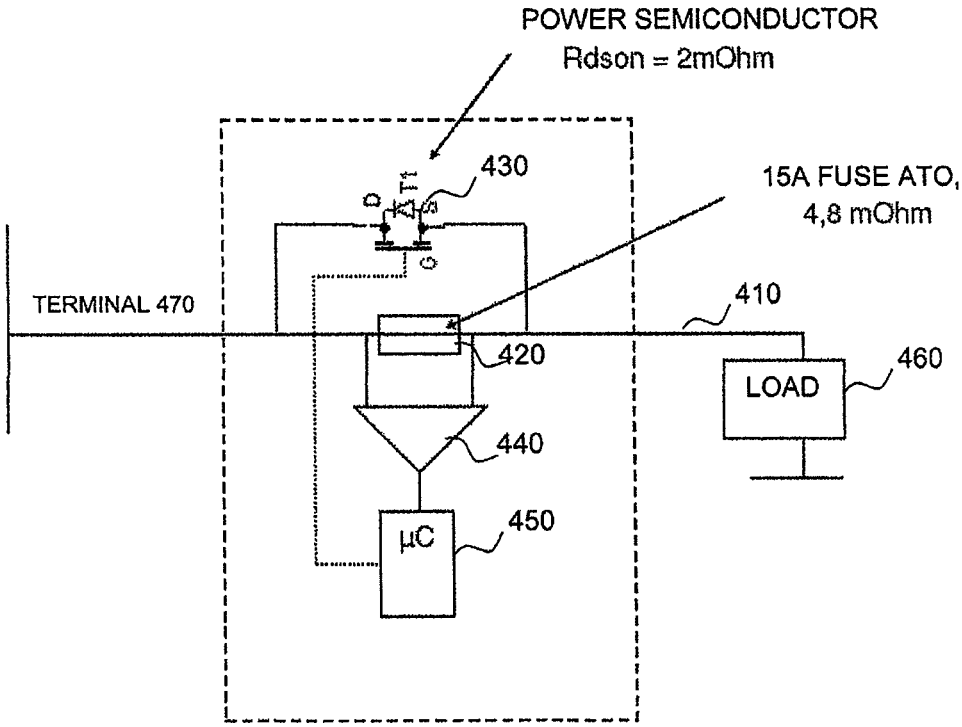
FIG. 4 shows individual elements of an apparatus for protecting an electric line, and in particular the control thereof, according to a further embodiment.

FIG. 4 shows individual elements of an apparatus for protecting an electric line, and in particular a control of the protection of an electric line 410 according to a further embodiment. The electric fuse 420, the controllable switching element 430, the comparator 440 and the control unit 450 basically correspond to the respective elements in FIG. 3. Moreover, a consumer load 460 of the vehicle on-board power supply system is connected to the electric line 410, and on the other side of the parallel circuit the latter is connected to terminal 470 consumer loads.

As can be seen from FIG. 4, the controllable switching element 430 is formed as a power MOSFET T1 which is controlled by the microcomputer 450, i.e. by applying an appropriate gate voltage, switching on and off and closing and opening can be implemented. Upon closing the power MOS- FET T1 this current branch has an electric resistance R3 of for example 2 mΩ which is smaller than the electric resistance R1 of the 15 A ATO cut-off fuse 420 which in FIG. 4, for example, has a value of 4.8 mΩ.

If, for example, the current across the cut-out fuse 420 exceeds 15 A (voltage threshold 15 A×4.8 mΩ=20 mV), the semiconductor switch T1 is switched on. If the current across the parallel circuit comprising the cut-out fuse 420 and the power semiconductor T1 falls (resistance=1.4 mΩ), the power semiconductor T1 is switched off again. The microcomputer 450 ensures that the power semiconductor T1 is only switched on for a maximum time, as is explained in the following, otherwise overloading of the electric line 410 can occur. When the power semiconductor T1 is switched on it absorbs 4.8/(2+4.8)=70% of the pulse load. Therefore, with a six-fold current increase of a starting current, the cut-out fuse 420 sees 12 A×6×30%=21.6 A instead of 72 A without the parallel power semiconductor T1, as is shown in point P in FIG. 5.

Consequently, upon closing the power MOSFET T1 the main part of the electric current of the electric line 410 flows through the power MOSFET and the cut-out fuse is unloaded. On the other hand, upon opening the gate of the power MOSFET T1 the latter has such a high electric resistance R2 that practically the whole of the electric current of the electric line 410 flows through the cut-out fuse 420.

In addition to the pulse condition for the electric fuse 420 described above, in particular for temporary strong current peaks, an overload condition for the electric line 410 is furthermore distinguished. This overload condition is a pulse load condition for a specific period, i.e. this overload condition of the electric line 410 is given if in general a specific electric current flows through the electric line 410 for too long a period.

According to the apparatus in FIG. 4, the case of an overload condition of the electric line 410 is determined by detecting a current through the parallel circuit and a duration of this current. In particular, this case of an overload condition can be determined such that after setting the pulse load condition, i.e. the first threshold value, the control unit 450 is configured to average the current over time, to integrate the square of the electric current flowing through the electric fuse 420 over time, or to average the product of the square of the current strength and time, and to compare the resulting value of this calculation continuously with an overload threshold value. When setting an overload condition, i.e. when the resulting value exceeds an overload threshold value, the power MOSFET 430 is controlled in order to switch from the second state into the first state once again. This leads to the electric current substantially flowing through the electric fuse 420 which is designed for this overload condition.

The adaptation of the overload threshold value using the product of the square of the current strength and of the time using $I^2t=a$ with a line-specific constant a corresponds to the thermal input into the electric fuse 420. This means in particular that there may not be a fixed overload threshold value, but the latter can be given by a current $I>\sqrt{a/t}$ with a current pulse length. The thermal input is proportional to a heat capacity and so corresponds to a temperature increase due to the current flow so that the electric fuse 420 can be adapted to the thermal properties thereof, and the overload threshold value corresponds to a thermal limit load.

The advantageous effect achieved in the apparatus shown in FIG. 4 is that a temporary increase in the current can be allowed by the electric line to e.g. 50-60 A since the greatest part of this current is absorbed by the semiconductor T1. However, if the current remains at these values, the semiconductor switch T1 is opened again, and the electric fuse 420 can trigger.

If, for example, the current exceeds the nominal load of the fuse of 15 A, for example at the time of the breaking away of a direct current motor as a load 460, the power semiconductor T1 is switched on and absorbs a large part of the pulse load. If the current remains over 40 A for longer than 10 secs, the power semiconductor T1 will switch off again in order to protect the electric line 410, and the cut-off fuse 420 will trigger if the current remains at this strength. Pulses up to 100 A can, for example, be absorbed by the power semiconductor for up to a second.

After the triggering of the electric fuse 420 the control unit 450 can once again close the power MOSFET T1 so that emergency operation for the electric line 410 and the consumer loads 460 can be maintained in the on-board power supply system of the vehicle. On the other hand, emergency operation can also take place if the power semiconductor T1 or the control unit 450 fail so that the load 460 is not separated, but can be supplied via the cut-out fuse 420. For terminal 470 consumer loads the standby current is supplied via the cut-out fuse 420. The power semiconductor T1 does not need to be controlled, which would only increase the standby current requirement.

Preferably, the apparatus can be used in an on-board power supply system of a vehicle, in particular an automobile, in order to protect an electric line. The apparatus can serve in particular for further integration of electronics into the on-board power supply system, e.g. by means of a current sensor. The protection of the electric line in a vehicle on-board power supply system can be implemented on the load plane (SRB plane) or the main distributor plane (Vosido plane).

Moreover, the apparatus for protecting an electric line 410 has further advantages in comparison to a protection only via a power semiconductor without a parallel cut-out fuse. For example, if with a hard short-circuit the power semiconductor breaks the connection (constricts current), a high voltage is induced which destroys the power semiconductor. This energy would have to be broken down in an additional free-wheeling diode. In the above apparatus the cut-out fuse 420 absorbs the energy, e.g. by fusing the fuse material. The power MOSFET T1 is therefore protected from induced voltages during triggering by the cut-out fuse 420.

Moreover, the power MOSFET T1 only absorbs the pulse currents, and so does not need to be designed thermally for the base load. With a stationary vehicle the supply of the standby current to the consumer loads in the current branch is implemented via the cut-out fuse. The power MOSFET does not need to be interconnected continuously. With regard to this, there is therefore no increase in the standby current in the vehicle.

Figure 5:
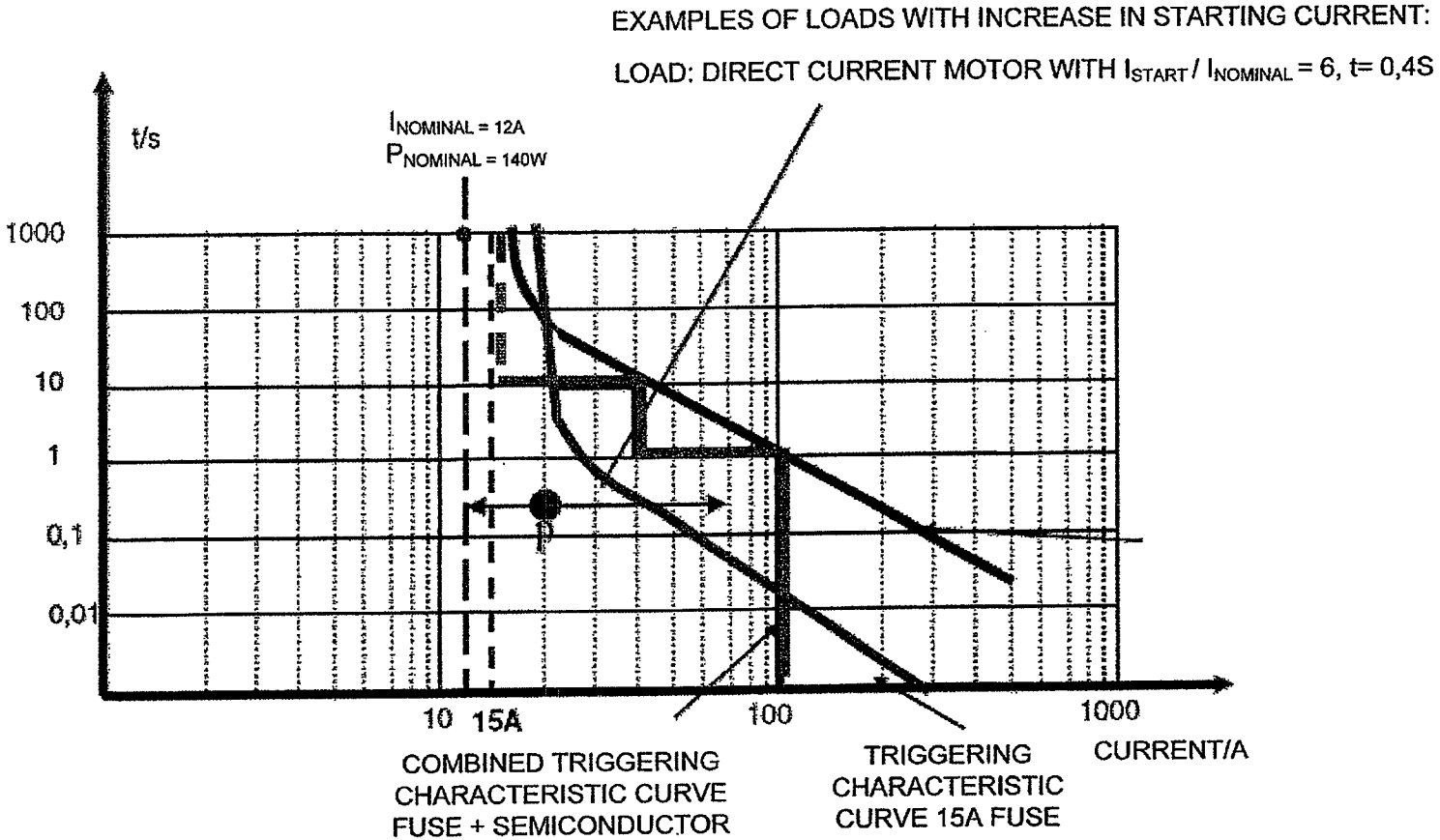
FIG. 5 shows a double logarithmic current triggering time characteristic curve for an electric line and an electric fuse according to one embodiment.
Figure 6:
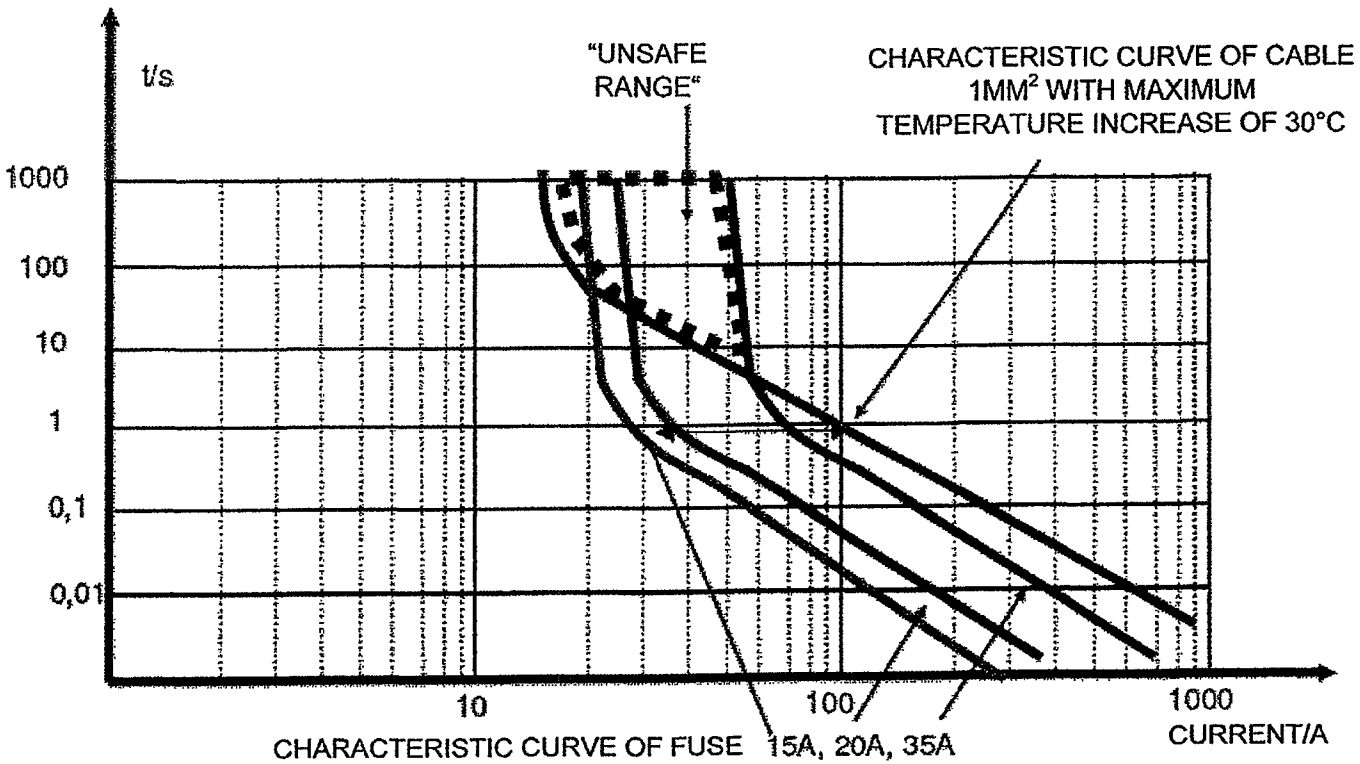
FIG. 6 shows a double logarithmic current triggering time characteristic curve for an electric line and electric fuses.

FIG. 5 shows a resulting current strength triggering time characteristic curve (I/t) when the above apparatus is used for protecting the electric line in a vehicle. As with characteristic curves in a conventional apparatus in FIG. 5 a triggering characteristic curve is shown for an electric line with a line cross-section of 1 $mm^2$ and a triggering characteristic curve of a 15 A cut-out fuse, neither of which are coordinated to one another with pulse loads of under 10 secs.

By means of the combined triggering characteristic curve of the fuse and the power semiconductor according to the above apparatus for protecting the electric line, an effective characteristic curve is now provided which is adapted to the triggering characteristic curve of the electric line both with permanent loads and with pulse loads.

As described in the above example, it can be seen in FIG. 5, for example, that when the current rises above the nominal load of the fuse of 15 A, for example at the time of the breaking away of a direct current motor as a load 460, the power semiconductor T1 is switched on and absorbs a large part of the pulse load. If the current remains over 40 A for longer than 10 secs, the power semiconductor T1 is switched off again in order to protect the electric line 410, and the cut-off fuse 420 will trigger if the current remains at this strength. Pulses up to 100 A are absorbed by the power semiconductor for up to a second.

From the description given above, the person skilled in the art can see that different modifications and variations of the apparatus and the method of the invention can be carried out without leaving the scope of the invention.

Furthermore, the invention was described with reference to specific examples which are only intended, however, to provide improved understanding of the invention, and not to restrict the latter. The person skilled in the art also sees immediately that many different combinations of the elements can be used in order to carry out the present invention. Therefore, the true scope of the invention is characterised by the following claims.

The invention claimed is:

1. An apparatus for protecting an electric line in a vehicle, comprising:

an electric fuse, and a controllable switching element, the controllable switching element and the electric fuse being formed as a parallel circuit, and the parallel circuit being connectable in series to the electric line, the electric fuse being disposed in a first branch of the parallel circuit, which has a first resistance, and the controllable switching element being disposed in a second branch of the parallel circuit, and the controllable switching element accommodating at least a first state and a second state, with the first state having a second resistance higher than the first resistance, and with the second state having a third resistance lower than the first resistance, wherein, during normal current conditions, the controllable switching element is in the first state, and wherein, when a pulse load condition is sensed, the controllable switching element switches from the first state where current primarily flows through the electric fuse into the second state where current flows primarily through the controllable switching element, wherein the pulse load condition exists when the current flowing through the parallel circuit exceeds a first threshold value, and wherein the controllable switching element switches from the second state into the first state:

1) upon an overload condition, wherein the overload condition exists when the current flowing through the parallel circuit remains above the first threshold for a specified duration, or 2) upon a drop in current flowing through the parallel circuit below a second threshold value.

2. The apparatus according claim 1, further comprising an ammeter which is connected in series to the electric fuse or the parallel circuit for measuring a current through the electric fuse and the parallel circuit, respectively.

3. The apparatus according to claim 1, further comprising a voltmeter which is connected in parallel to the electric fuse or the parallel circuit for measuring a voltage.

4. The apparatus according to claim 1, further comprising a control unit for controlling the controllable switching element dependent on the current flowing through the parallel circuit or dependent on the current flowing through the parallel circuit and a duration of the current.

5. The apparatus according to claim 1, wherein the controllable switching element is a power semiconductor.

6. The apparatus according to claim 5, wherein the power semiconductor is a power MOSFET.

7. The apparatus according to claim 1, wherein the electric fuse is a cut-out fuse.

8. A method for protecting an electric line in a vehicle, to which a parallel circuit including a controllable switching element and an electric fuse is connected in series, comprising the step:

switching the controllable switching element from a first state with a second resistance higher than a first resistance of the electric fuse into a second state of the controllable switching element with a third resistance lower than the first resistance when there is a pulse load condition, wherein the controllable switching element is in the first state during normal current conditions and wherein the pulse load condition exists when the current flowing through the parallel circuit exceeds a first threshold value, and switching the controllable switching element from the second state back into the first state:

1) upon an overload condition, wherein the overload condition exists when the current flowing through the parallel circuit remains above the first threshold for a specified duration, or 2) upon a drop in current flowing through the parallel circuit below a second threshold value.

9. The method according to claim 8, further comprising the step: determining whether the pulse load condition exists by measuring a current through the parallel circuit.

10. The method according to claim 8, further comprising the step: determining whether an overload condition exists by measuring a current through the parallel circuit and a duration of the current.

* * * * *